United States Patent [19]

Gustafson

[11] Patent Number: 4,956,975

[45] Date of Patent: Sep. 18, 1990

[54] SHUTOFF VALVE FOR CRYOGENIC LIQUID STORAGE TANK

[76] Inventor: Keith W. Gustafson, Station 1101, Lake Arrowhead, Waleska, Ga. 30183

[21] Appl. No.: 395,324

[22] Filed: Aug. 17, 1989

[51] Int. Cl.[5] ..... F17C 13/00

[52] U.S. Cl. ..... 62/50.7; 137/202; 137/210

[58] Field of Search ..... 62/50.7; 137/202, 209, 137/210

[56] References Cited

U.S. PATENT DOCUMENTS

| | | | |
|---|---|---|---|
| 3,431,744 | 3/1969 | Veilex et al. | 62/50.6 |
| 4,586,343 | 5/1986 | Buschkens et al. | 62/50.1 |
| 4,625,753 | 12/1986 | Gustafson | 62/50.7 |

*Primary Examiner*—Ronald C. Capossela

*Attorney, Agent, or Firm*—Jones, Askew & Lunsford

[57] ABSTRACT

There is disclosed an improved internal pressure relief valve for filling a cryogenic liquid storage tank. The internal pressure relief valve consists of a housing with a sealing seat at one end, an inlet hole at the other end, and a ball enclosed therein. The internal pressure relief valve is constructed of materials which can withstand the heat encountered during fabrication without melting. Consequently, the material for the ball is more dense than the cryogenic liquid in the tank so that the ball will not float in the cryogenic liquid. Consequently, the ball and the housing are dimensioned so that the momentum of the cryogenic liquid as it flows into the housing toward a vent port during the filling operation is sufficient to drive the ball into engagement with the sealing seat, closing the vent port, and assuring the termination of the filling process when the pressure in the cryogenic tank builds up to that of the delivery pressure.

3 Claims, 2 Drawing Sheets

SHUTOFF VALVE FOR CRYOGENIC LIQUID STORAGE TANK

BACKGROUND OF THE INVENTION

Figure 1:
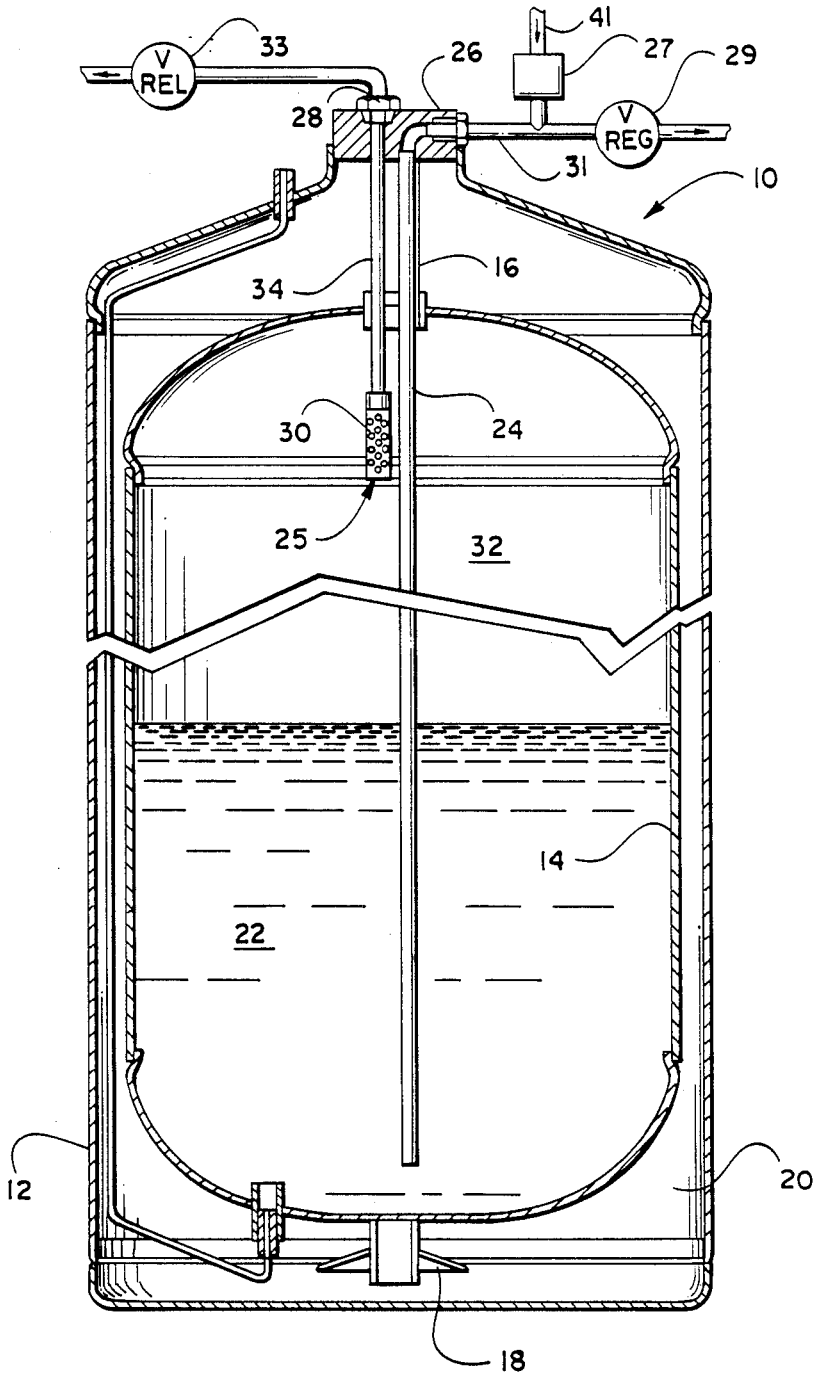

This invention relates generally to a cryogenic liquid storage tank, and more particularly concerns a cryogenic liquid storage tank having means for relieving the internal head pressure during filling in order to fill completely the cryogenic tank with cryogenic liquid.

Gases, having low boiling points at atmospheric pressures, such as carbon dioxide ($CO_2$) and oxygen ($O_2$), for example, present many difficulties and problems not encountered handling ordinary gases. In order to provide $CO_2$ gas for use in fast food restaurants for carbonating soft drinks, for example, it has been necessary in the past to provide the compressed $CO_2$ in single or clustered high pressure containers which are really best suited for customers with low consumption or sporadic use. Such service is expensive because of the high cost of handling the necessary heavy containers the weight of which is very high in comparison to the weight of the compressed gas contained therein.

Customers having high or moderately high demands for $O_2$ or $CO_2$ gas have also been serviced by means of high pressure tubular receivers installed on their premises. Such receivers are periodically serviced by means of a pump equipped liquid tank truck which transports the material to the customer's premises in cryogenic liquid form and charges such receivers with high pressure gas drawn from the vaporized cryogenic liquid in the tank truck. These tank trucks must be specifically equipped for this service and represent a large capital expense. Furthermore, the delivery of gas is time consuming because of the limiting capacity of the portable high pressure pumps.

Another way of storing such low boiling point gases, such as $O_2$ and $CO_2$, is to store them in a cryogenic storage tank in liquid form on the user's premises. Such a cryogenic liquid storage tank includes an inner vessel which holds the cryogenic liquid and an outer vessel within which the inner vessel is supported. There is an insulating space between the inner and outer vessels in which a vacuum is drawn and insulating material is positioned. Because of the low heat transfer from the ambient atmosphere outside of the outer vessel to the contents of the inner vessel, the liquid $O_2$ or $CO_2$ can remain in liquid form for some period of time before heat vaporization causes the vapor pressure of the $O_2$ or $CO_2$ to exceed a maximum pressure and to activate a regulator system for maintaining the vapor pressure within a safe range.

When such a cryogenic tank is installed on a customer's premises, such as a $CO_2$ tank at a fast food restaurant, it is necessary periodically to refill the cryogenic tank with liquid $CO_2$. The cryogenic $CO_2$ tank is filled by means of a delivery truck carrying $CO_2$ cryogenic liquid which makes its rounds from one customer to the next. In order to achieve the greatest efficiency, it is important to be able to fill the customer's tank as nearly full as possible without resorting to sophisticated high pressure pumps and/or regulator systems.

One way of filling a cryogenic tank on the customer's premises is to attach a single hose from a cryogenic tank on a transport truck to the inlet of the customer's cryogenic liquid storage tank. The vapor pressure in the transport truck's tank forces the liquid from the transport tank into the cryogenic tank on the customer's premises. As the liquid flows into the customer's cryogenic tank, the increase volume of liquid in the customer's cryogenic tank compresses the vapor above the liquid into a smaller and smaller space until the vapor pressure in the customer's tank exactly equals the vapor pressure in the transport tank. At that point, transfer from the transport tank to the customer's tank ceases even though the customer's tank may only be partially full.

In order to relieve the vapor pressure in the customer's cryogenic tank, the prior art suggests various ways of liquifying the $CO_2$ vapor in the top of the customer's tank by means of eductors, J-shaped bubbler tubes, or J-shaped sprinkler tubes, all of which are shown in Remes et al., Ser. No. 448,729, filed Dec. 10, 1982 now abandoned.

Another way of assuring complete filling of the customer's cryogenic tank is disclosed in the applicant's prior patent, Gustafson U.S. Pat. No. 4,625,753, in which an automatic pressure relief means vents the $CO_2$ vapor while the tank is being filled so that the tank may be completely filled. The automatic pressure relief means includes a cylindrical housing which is connected to the lower end of a vent tube. The housing has perforations to allow entry of cryogenic liquid. A buoyant float ball is enclosed within the housing. As the cryogenic tank is filled, the buoyant float ball floats upwardly into contact with an O-ring seat at the bottom of the vent tube thereby causing the pressure relief means automatically to close the vent tube. In an alternative embodiment of that invention, the automatic pressure relief means is combined with an eductor attached to the tank's inlet. The eductor entrains and condenses vapor within the tank to minimize the amount of vapor vented by the automatic pressure relief means.

While the automatic pressure relief means disclosed and claimed in Gustafson U.S. Pat. No. 4,625,753 performs the function of venting the tank so that the tank may be filled completely, the automatic pressure relief means uses a float ball which floats on the cryogenic liquid to close off the vent port once the cryogenic liquid has reached the vent tube at the top of the tank. In order to float in liquid $CO_2$ or $O_2$, the material for float ball is general confined to a plastic material. The use of a plastic material for the float ball limits the temperature in the tank the melting point of the plastic. During the manufacture of the vessel, the necessary welding operations cause the inside temperatures in the tank to exceed the melting points of available plastics. Consequently, the automatic pressure relief means with its plastic float ball can only be positioned inside the inner vessel after the inner vessel has cooled. Consequently, it is necessary that the automatic pressure relief means with its plastic float ball be attached to the outlet pipe by means of a threaded connector which can be installed after the welding operations have ended and the tank has had an opportunity to cool. Such an assembly constraint increases assembly time and results in a threaded connection that may be subject to failure.

SUMMARY OF THE INVENTION

It is therefore an object of the present invention to provide an automatic pressure relief means for a cryogenic liquid storage tank which does not employ materials that will melt at the temperatures encountered during the fabrication process of the cryogenic tank.

In order to achieve the foregoing objective, the automatic pressure relief means includes a cylindrical housing attached to a vent tube having a seat at one end. The other end of the vent tube is attached to a safety regulator valve to vent gas to the atmosphere. The cylindrical housing is closed except for a hole at its lower end. A steel ball, which has a diameter greater than the hole in the lower end of the housing, is contained within the housing below the seat. As the cryogenic tank is filled, the steel ball first responds to the momentum of the gas escaping through the vent tube and is lifted toward the seat. When the cryogenic liquid reaches the steel ball, the addition momentum of the liquid with its greater mass drives the steel ball into engagement with the seat and substantial halts the escape of gas through the vent tube. Once the steel ball has engaged the seat, the difference in pressure between the gas in the tank and the setting of the safety regulator valve on the vent tube holds the steel ball in place against the seat until the filling operation is complete, and the pressure in the tank has decayed to the operating pressure of the tank. Although the steel ball does not float in the cryogenic liquid, the momentum of the liquid against the steel ball in the enclosed housing is sufficient to drive the steel ball against the seat and substantially seal off the vent tube.

Other objects and advantages of the invention will become apparent upon reading the following detailed description and upon reference to the drawings.

BRIEF DESCPRIPTION OF THE DRAWINGS

Figure 2:
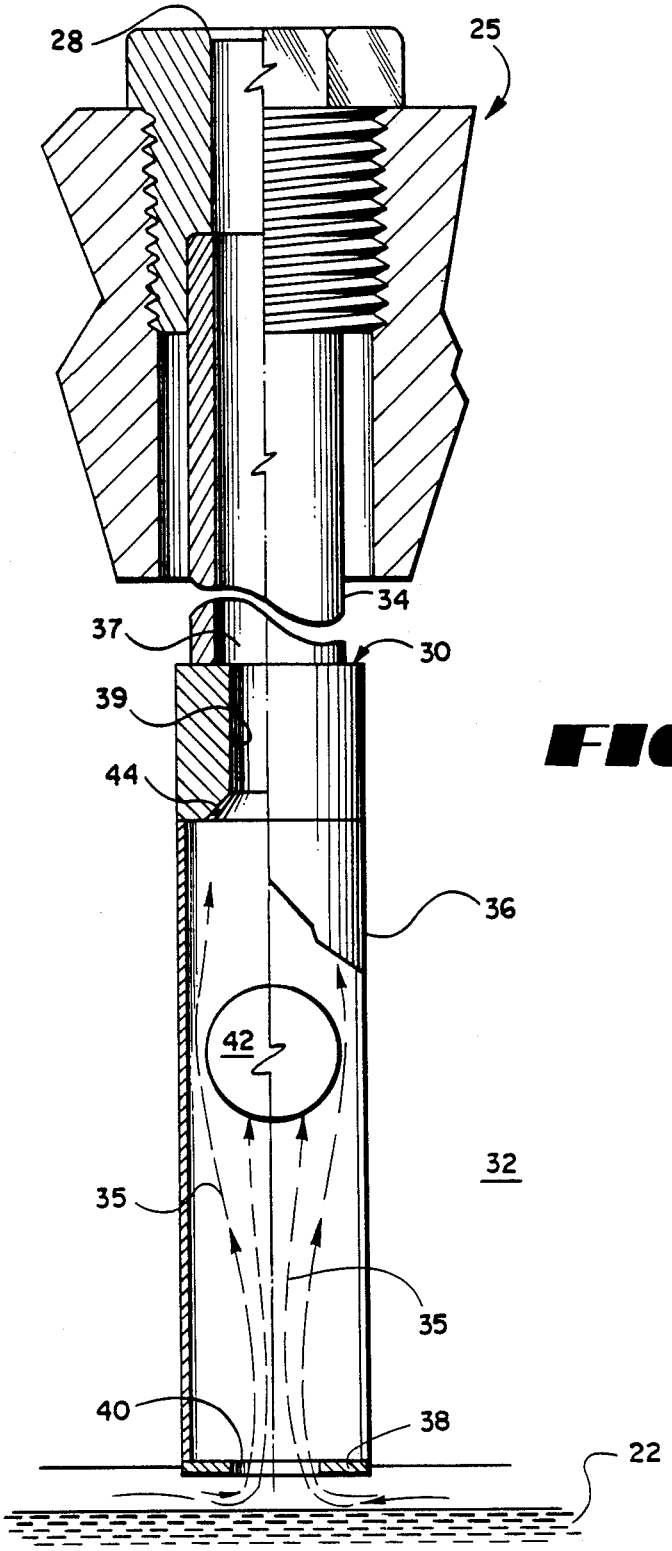

FIG. 1 is an elevation view, partly in vertical cross-section, showing a cryogenic tank embodying the present invention; and FIG. 2 is a detailed view, partly in cross-section, of an internal pressure relief valve in accordance with the present invention for the cryogenic tank.

DETAILED DESCRIPTON OF THE INVENTION

While the invention will be described in connection with the preferred embodiment, it will be understood that I do not intend to limit the invention to that embodiment. On the contrary, I intend to cover all alternatives, modifications, and equivalents as may included within the spirit and the scope of the invention as defined by the appended claims.

Turning to FIG. 1, there is shown a cryogenic tank 10 having an outer vessel 12 and an inner vessel 14. The inner vessel is suspended within the outer vessel by means of a neck 16 and a base support 18. An insulating space 20 located between the inner vessel and the outer vessel is evacuated to create a vacuum and is insulated thereby minimizing the amount of heat transfer from the ambient atmosphere outside of the tank 10 to the contents of the inner vessel 14. The inner vessel 14 contains liquified gas, such as $CO_2$, in the liquid phase 22 with a vapor phase 32 disposed above the liquid 22.

The neck 16 provides a sealable port from outside of the tank 10 to the inside of inner vessel 14. An inlet/outlet pipe 24 for filling and emptying vessel 14 extends through the neck 16 and has an inlet/outlet port 26 at the top of the tank 10. The pipe 24 also extends nearly to the bottom of the inner vessel. A self-closing coupling 27 and an outlet pressure regulator 29 are connected to the inlet/outlet port 26 by means of pipe 31.

A pressure relief means 25 includes a vent tube 34 which extends through the neck 16 and which has an exhaust port 28 at its top end and an internal pressure relief valve 30 at its lower end. The internal pressure relief valve 30 only extends a short distance into the vapor space at the top of the inner vessel 14. A safety pressure relief valve 33 is connected to exhaust port 28 and has a pressure set point above the operating pressure (emptying pressure) of the tank and below the higher delivery pressure (filling pressure) of the tank.

Turning to FIG. 2, the internal pressure relief valve 30 includes a cylindrical housing 36 which is connected to the bottom end 37 of the vent tube 34. The housing 36 is enclosed except that its lower end 38 has a hole 40 therein to allow entry of gas 32 and liquid 22. Near the top of the housing 36 there is provided a tapered seat 44 which surrounds an opening 39 leading to the vent tube 34. Enclosed within the housing 36 is a ball 42 which is formed of steel for example. Other materials may be used as long as they have sufficiently high melting temperatures so that the ball can remain within the housing 36 while the tank is being welding during fabrication. Materials that can withstand the heat of fabrication are too dense to float in the cryogenic liquid in the inner vessel 14. Consequently one cannot rely on the buoyancy of the ball 42 to force the ball into contact with the tapered seat and close the internal pressure relief valve 30. I have discovered that the momentum of the cryogenic liquid flowing into the housing 36 can be used to propel the ball 42 into engagement with the tapered seat 44 and substantially close the internal pressure relief valve 30.

In order to fill the tank 10 (FIG. 1), a single delivery hose 41 from a transport tank (not shown) is connected to the inlet/outlet port 26 by means of the coupling 27 and pipe 31. The vapor pressure in the transport tank causes the cryogenic liquid in the transport tank to flow through the hose 41, through coupling 27, through pipe 31, through pipe 24, and into the inner vessel 14. As the cryogenic fluid 22 rises in the inner vessel 14, the vapor pressure increases until it exceeds the set point of safety pressure relief valve 33. Once the set point of safety pressure relief valve 33 is exceeded, the vapor 32 escapes (as shown by arrows 35 in FIG. 2) through the internal pressure relief valve 30, the vent tube 34, the exhaust port 28, and the safety pressure relief valve 33, which has its set point below the pressure of the transport tank. Consequently, the vapor 32 is vented to the atmosphere instead of being compressed above the liquid 22 and creating back pressure sufficient to counteract the vapor pressure in the transport tank. As the vapor 32 escapes through the vent tube 34, it necessarily passes through the hole 40 and the housing 36. As the gas 32 passes through the housing 36, the momentum of the escaping gas causes the steel ball 42 to rise within the housing 46 toward the tapered seat 44. The steel ball and housing are dimensioned such that the momentum of the gas is not sufficient to drive the steel ball into engagement with the tapered seat 44. Once the liquid $CO_2$ 22 rises to the opening 40 of the enclosed housing 36, liquid is forced through hole 40 and into the enclosed housing 36. Because the liquid $CO_2$ has a greater mass and therefore greater momentum than the gas 32, the momentum of the liquid flowing into the housing 36 is sufficient to drive the steel ball 42 into engagement with the tapered seat 44.

To assure proper operation of the internal pressure relief valve 30, the dimensioning of the steel ball and the enclosed housing 36 is critical. Particularly, in a preferred embodiment of the present invention in which a steel ball is used, I have found that a ½ inch steel ball performs satisfactorily when the inside diameter of the housing 36 is $\frac{5}{8}$ inch. Moreover, for a steel ball with a diameter of $\frac{1}{2}$ inch, the inside diameter of the housing must be $\frac{5}{8}$ inch plus or minus 1/32 inch. If the inside diameter of the housing 36 is too small, the momentum of the gas will be sufficient to drive the steel ball into engagement with the tapered seat 44 prematurely closing the internal pressure relief valve 30 and preventing the tank from being completely filled. If, on the other hand, the inside diameter of the housing 36 is too large, the momentum of the liquid 22 will not be sufficient to drive the steel ball 42 into engagement with the tapered seat 44, and the internal pressure relief valve 30 will not close allowing escape of liquid as the tank continues to fill.

If another heat resistant material other than steel is used for the ball 42, such as a lighter weight heat resistant material, the tolerances on the inside diameter should be less critical. Likewise, using a tapered housing which has a greater diameter at the top and a smaller diameter at the bottom (much like the tapered seat 44) should likewise provide for less critical dimensional tolerances between the inside diameter of the housing and the diameter of the ball.

Once the float ball 42 engages the tapered seat 44, further escape of liquid 22 or vapor 32 from within the inner vessel 14 is substantially inhibited although the metal to metal contact between the ball and the tapered seat will not provide a complete seal. In the context of the present invention the tapered seat 44 which substantially inhibits the escape of liquid and gas is considered a sealing seat. The use of a sealing gasket such as the O-ring employed by the prior art has been eliminated because such sealing gaskets are generally made of materials that cannot stand the heat of manufacture or if capable of withstanding such heat, are expensive. Moreover, the seal created by the ball and tapered leaks only a small amount of gas and only for the time that the vapor pressure exceed the set point of the safety pressure relief valve.

Even after the valve 30 has been substantially closed by means of the steel ball 42, cryogenic fluid will continue to flow into the tank until the vapor pressure in the vapor space in the inner vessel 14 equals that of the vapor pressure in the transport tank. That further increase in the level of the liquid in the tank 10 increases the internal vapor pressure inside the inner vessel 14, and the resulting pressure differential between the inside of the inner vessel 14 and the set point of the safety pressure relief valve 33 insures that the steel ball is securely seated against the tapered seat 44 to insure against further significant venting of vapor or escape of liquid during the filling process. Once the cryogenic tank 10 has been filled, the transport tank hose 41 is uncoupled from self-closing coupling 27.

As the gas 32 is subsequently withdrawn from vessel 14 through regulator 29, the pressure of the vapor 32 will be reduced below the set point of safety pressure relief valve 33, and the steel ball 42 will drop from engagemnet with the tapered seat 44. With the steel ball 42 disengaged from tapered seat 44, the tank 10 is ready for the next filling operation.

In filling tank 10 in FIG. 1, the small amount of $CO_2$ vapor and liquid that escapes during the filling operation through port 28 is less economically important than the cost of providing a skilled transport operator and/or sophisticated pumping and venting apparatus. Also, the cost of the vented $CO_2$ vapor and liquid is small when compared to the cost of additional delivery visits that would result if the tank 10 is only partially filled.

What is claimed:

1. In a cryogenic fluid storage tank having an inner vessel for holding a cryogenic fluid in a liquid phase with a gas phase disposed above the liquid phase, an outer vessel with an insulating space between the inner and outer vessels, a sealable access port connected to the inner vessel to provide sealed access from outside the outer vessel to inside the inner vessel, an inlet tube extending from outside the outer vessel through the access port into the inner vessel, and vapor pressure relief means having a pressure relief valve outside the tank connected to a vent tube extending from outside the outer vessel through the access port into the vapor space inside the inner vessel, the improvement comprising an internal pressure relief valve comprising an enclosed housing having a sealing seat at one end attached to the vent tube and having a hole at its other end and a ball confined in the housing wherein the ball's density is greated than the liquid, and the ball's diameter and the inside diameter of the housing are dimensioned so that the momentum of the liquid flowing through the housing is sufficient to drive the ball into engagement with the seat at the top of the housing but the momentum of the gas flowing through the housing is insufficient to drive the ball into engagement with the seat at the top of the housing.

2. The cryogenic fluid storage tank of claim 1, wherein the housing is circular in cross/section.

3. The cryogenic fluid storage tank of claim 2, wherein the liquid is liquid $CO_2$, the ball is made of steel and has a diameter of $\frac{1}{2}$ inch, and the housing has an inside diameter of $\frac{5}{8}$ inch plus or minus 1/32 inch.

* * * * *